US011071994B2

(12) United States Patent
Wen

(10) Patent No.: US 11,071,994 B2
(45) Date of Patent: Jul. 27, 2021

(54) CLEANING DEVICE FOR NOZZLE

(71) Applicants: HKC CORPORATION LIMITED, Guangdong (CN); CHONGQING HKC OPTOELECTRONICS TECHNOLOGY CO.,LTD., Chongqing (CN)

(72) Inventor: Chun-Bin Wen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 130 days.

(21) Appl. No.: 16/475,806

(22) PCT Filed: Jan. 4, 2018

(86) PCT No.: PCT/CN2018/071254

§ 371 (c)(1),
(2) Date: Jul. 3, 2019

(87) PCT Pub. No.: WO2018/127058

PCT Pub. Date: Jul. 12, 2018

(65) Prior Publication Data

US 2019/0321848 A1 Oct. 24, 2019

(30) Foreign Application Priority Data

Jan. 5, 2017 (CN) ..... 201720011330.X

(51) Int. Cl.

| | |
|---|---|
| ***B05B 15/50*** | (2018.01) |
| ***B08B 1/00*** | (2006.01) |
| ***B05B 15/52*** | (2018.01) |

(52) U.S. Cl.

CPC ..... *B05B 15/50* (2018.02); *B05B 15/52* (2018.02); *B08B 1/005* (2013.01); *B08B 1/008* (2013.01)

(58) Field of Classification Search

CPC ..... B05B 15/50; B05B 15/52; B05B 15/522; B05B 15/02; B05B 15/0208; B05C 5/02;

(Continued)

(56) References Cited

FOREIGN PATENT DOCUMENTS

| | | |
|---|---|---|
| CN | 101204707 A | 6/2008 |
| CN | 102161028 A | 8/2011 |

(Continued)

OTHER PUBLICATIONS

International Search Report, dated Mar. 28, 2018, for HKC Corporation Limited et al., International Application No. PCT/CN2018/071254, dated Jan. 4, 2018.

(Continued)

*Primary Examiner* — Mark Spisich
(74) *Attorney, Agent, or Firm* — Law Offices of Albert Wai-Kit Chan, PLLC

(57) ABSTRACT

The present disclosure provides a cleaning device for nozzle, which includes: a base seat and a plurality of scrape components defined on the base seat, the scrape components are arranged in a straight line, a rear end of each of the scrape components form a notch, the notches match with the nozzle, the nozzle passes through the notches of all the scrape components in sequence and contracts with all the scrape components when the nozzle is scraped, to scrape the residue photoresist away from the nozzle by scraping the nozzle multiple times.

14 Claims, 2 Drawing Sheets

(58) Field of Classification Search
CPC ..... B05C 11/00; B05C 21/00; B08B 1/00; B08B 1/001; B08B 1/005; B08B 1/008; B08B 2240/00
USPC ... 15/93.1, 104.001, 104.03, 104.04, 236.01, 15/236.05–236.09, 256.5; 118/302; 134/104.1; 239/114, 115, 123
See application file for complete search history.

(56) References Cited

FOREIGN PATENT DOCUMENTS

| | | | | |
|---|---|---|---|---|
| CN | 102688830 | A | | 9/2012 |
| CN | 206425274 | U | | 8/2017 |
| JP | 2007237122 | A | | 9/2007 |
| JP | 2012-200614 | | * | 10/2012 |
| JP | 2017-29880 | | * | 2/2017 |
| KR | 100832169 | B1 | | 5/2008 |

OTHER PUBLICATIONS

Written Opion, dated Mar. 28, 2018, for HKC Corporation Limited et al., International Application No. PCT/CN2018/071254, dated Jan. 4, 2018.

* cited by examiner

CLEANING DEVICE FOR NOZZLE

FIELD

The present disclosure generally relates to the technical field of manufacturing display device, and more particularly relates to a cleaning device for nozzle.

BACKGROUND

Thin-film Transistor Liquid-crystal Display (TFT-LCD) is formed by matching a thin film transistor (TFT) array substrate with a color film (CF) substrate. During a process for preparing CF, it needs to coat a RGB film. The RGB film is one of the main raw materials for manufacturing a color LCD display, and is a film substrate which defines R pixels, G pixels, and B pixels arranged in a certain sequence. However, the material for coating the ROB film is prone to adhere to a nozzle, thereby causing a residue of photoresist.

SUMMARY

The present disclosure provides a cleaning device for nozzle, which includes: a base seat and a plurality of scrape components defined on the base seat, the scrape components are arranged in a straight line, a rear end of each of the scrape components form a notch, the notches match with the nozzle, the nozzle passes through the notches of all the scrape components in sequence and contracts with all the scrape components when the nozzle is scraped.

Electively, the rear end of each of the scrape components defines two bevels, one end of one bevel joints with one end of the other bevel, the other ends of the two bevels incline along directions of away from each other respectively, the two bevels cooperatively form the notch, when the nozzle is scraped, the nozzle passes through the notches of all the scrape components in sequence, the bevels rub the nozzle.

Electively, the base seat includes a base and two fixing parts spaced from each other, each of the fixing parts defines a receiving groove extending from the end of the fixing part away from the base towards the base, each of the fixing grooves receives one scrape component.

Electively, the base seat further includes a first fixing plate and a second fixing plate, two opposite sides of each of the fixing parts are fixed with the first fixing plate and the second fixing plate, the first fixing plate and the second fixing plate are parallel to the fixing part respectively, and the rear end of the scrape component having the notch is exposed from the first fixing plate, the second fixing plate, and the fixing part along a direction of away from the base.

Electively, the base seat is further defined with a separating plate, the separating plate is located between the two fixing parts, and located between the second fixing plates of the two fixing parts.

Electively, the separating plate and each of the fixing parts cooperatively form a fixing groove, the second fixing plate is fixed in the fixing groove.

Electively, the rear end of the first fixing plate defines two symmetrical broken corners, a position of the fixing part facing the broken corner defines a fastener for fixing the second fixing plate.

Electively, the other end of the first fixing plate is fixed on the fixing part.

Electively, the two fixing parts are symmetrically set, and the rear ends of the fixing parts both define a bevel.

The exemplary embodiment of the present disclosure provides a cleaning device for nozzle, the cleaning device can rub the sundries on the nozzle to clean the nozzle. In addition, the cleaning device for the nozzle can be mounted with a plurality of scrape components, as such multiple scrape components of the cleaning device for the nozzle can contract with the nozzle simultaneously to clean the nozzle, the pressure on per unit area is reduced, the abrasion of the scrape components is also reduced. Furthermore, the nozzle is scraped over and over to reduce the photoresist residue of the nozzle.

BRIEF DESCRIPTION OF THE DRAWINGS

To better illustrate the technical solutions that are reflected in various embodiments according to this disclosure or that are found in the prior art, the accompanying drawings intended for the description of the embodiments herein or for the prior art will now be briefly described, it is evident that the accompanying drawings listed in the following description show merely some embodiments according to this disclosure, and that those having ordinary skill in the art will be able to obtain other drawings based on the arrangements shown in these drawings without making inventive efforts.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present invention without creative efforts shall fall within the protection scope of the present invention.

It should be understood that the terms used in this specification and claims such as "comprising" and "including" refer to the existence of the described characteristics, steps, operations, elements and/or components, without excluding one or more other characteristics, steps, operations, elements and/or components, or the existence or addition of their sets.

It is also to be understood that, the terms described in the present disclosure are only for description of specific embodiment, rather than limiting the scope of the disclosure. As described in the specification and claims of the present disclosure, "a", "one" and "this" is used for description of subject including the plural form, unless other situation is clearly defined in the context.

Figure 1:
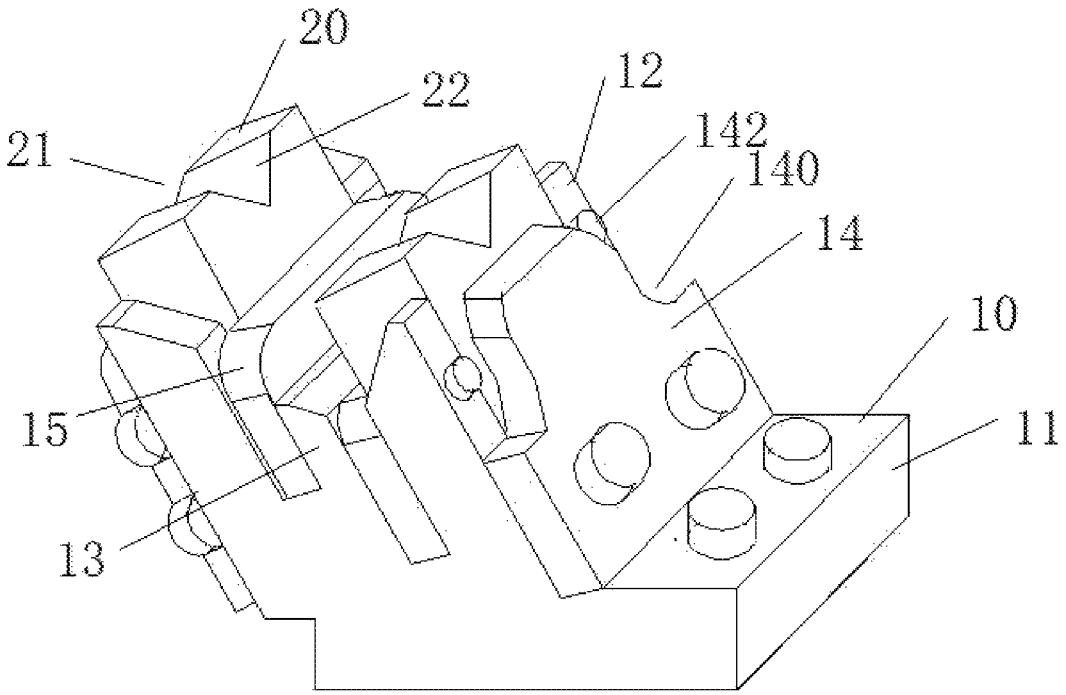
FIG. 1 is a structure diagram of a cleaning device for nozzle according to a first exemplary embodiment.
Figure 2:
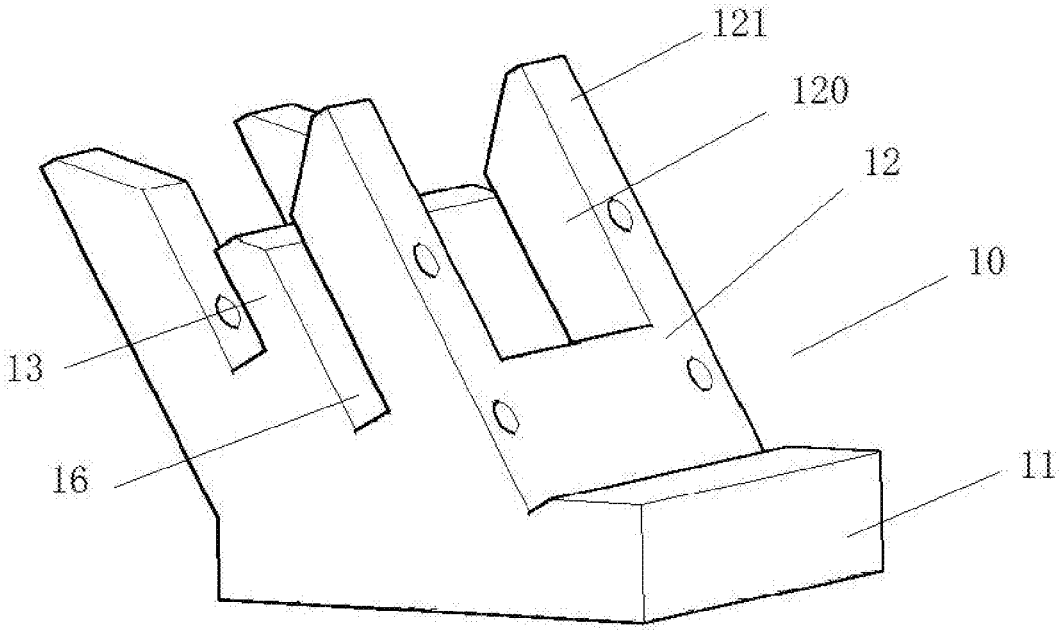
FIG. 2 is a structure diagram of a base seat of the cleaning device for the nozzle.

Referring to FIG. 1, which is a structure diagram of a cleaning device for nozzle according to a first exemplary embodiment. The device includes a base seat 10 and a plurality of scrape components 20 defined on the base seat 10. in the exemplary embodiment, taking two scrape components 20 as an example.

The scrape components 20 are arranged in a straight line, a rear end of each of the scrape components 20 form a notch 21, the notches 21 match with the nozzle (not shown). When the nozzle is scraped, the nozzle passes through the notches 21 of all the scrape components 20 in sequence and contracts with all the scrape components 20, as such there would be friction between the scrape components 20 and the nozzle, sundries on the nozzle can be scraped away, so as to achieve the aim of cleaning the nozzle.

Electively, the rear end of each of the scrape components 20 defines two bevels 22, one end of one bevel 22 joints with one end of the other bevel 22, the other ends of the two bevels 22 incline along directions of away from each other respectively, the two bevels 22 cooperatively form the notch 21, when the nozzle is scraped, the bevels 22 rub the nozzle. In some feasible exemplary embodiments, the shape of the notch 21 of the scrape component 20 can be adjusted according to the shape of the nozzle, to ensure that the notches 21 match with the nozzle. For example, when the shape of the nozzle 21 is hemispherical, the notch of the scrape component 20 is adjusted to be hemispherical accordingly.

The base seat 10 includes a base 11, two fixing parts 12 spaced from each other, a separating plate 13 located between the fixing parts 12, two pairs of first fixing plates 14, and two pairs of second fixing plates 15. Each of the fixing parts 12 has a plate structure which inclines relatively to the base seat 10. The two fixing parts 12 are symmetrically arranged. Each of the fixing parts 12 defines a receiving groove 120 extending from the end of the fixing part 12 away from the base 11 towards the base 11, as such the fixing part 12 forms two clamping blocks 121, each of the receiving grooves 120 receives one scrape component 20.

The separating plate 13 is located between the two fixing parts 12, the separating plate 13 and each of the fixing parts 12 cooperatively form a fixing groove 16, the second fixing plate 15 is fixed in the fixing groove 16, that is, the separating plate 13 is located between the second fixing plates 15 of the two fixing parts 12.

Each pair of the first fixing plate 14 and the second fixing plate 15 are parallel to the fixing part 12 respectively, and the rear end of the scrape component 20 having the notch 21 is exposed from the first fixing plate 14, the second fixing plate 15, and the fixing part 12 along a direction of away from the base 11.

The rear end of the first fixing plate 14 defines two symmetrical broken corners 140, two fasteners 142 are respectively defined at positions of the fixing parts 12 relative to the broken corners 140, as such the second fixing plate 15 is fixed on the fixing part 12. The two fastener 142 are fixed with the other end of first fixing plate 14, to fix the first fixing plate to the fixing part 12. The scrape component 20 is clamped between the first fixing plate 14 and the second fixing plate 15.

In the above exemplary embodiments, a cleaning device for nozzle is provided, the cleaning device for nozzle can scrape the sundries away from the nozzle to clean the nozzle. In addition, the cleaning device for the nozzle can be mounted with a plurality of scrape components, as such multiple scrape components of the cleaning device for the nozzle can contract with the nozzle simultaneously to clean the nozzle, the pressure on per unit area is reduced, the abrasion of the scrape components is also reduced. Furthermore, the nozzle is scraped over and over to reduce the photoresist residue of the nozzle.

The foregoing descriptions are merely specific implementation manners of the present application, but are not intended to limit the protection scope of the present application. Any variation or replacement readily figured out by a person skilled in the art within the technical scope disclosed in the present application shall fall within the protection scope of the present application. Therefore, the protection scope of the present application shall be subject to the protection scope of the claims.

What is claimed is:

1. A cleaning device for a nozzle, comprising:

a base seat; and a plurality of scrape components, the scrape components being defined on the base seat and arranged in a straight line, a rear end of each of the scrape components forming a notch, notches of the scrape components matching with the nozzle;

wherein, the nozzle passes through the notches of all the scrape components in sequence and contacts with all the scrape components when the nozzle is scraped;

wherein, the base seat comprises:

a base; and two fixing parts spaced from each other, wherein each of the fixing parts defines a receiving groove extending from an end of the fixing part away from the base towards the base, each of receiving grooves receives one scrape component;

wherein, the base seat further comprises:

two first fixing plates and two second fixing plates, two opposite sides of each of the fixing parts are fixed with a first fixing plate and a second fixing plate, the first fixing plate and the second fixing plate are parallel to the fixing part respectively, and the rear end of the scrape component with the notch is exposed from the first fixing plate, the second fixing plate, and the fixing part along a direction away from the base;

wherein, the base seat is further defined with a separating plate, the separating plate is located between the second fixing plates of the two fixing parts.

2. The cleaning device according to claim 1, wherein the nozzle and the notches all have a hemispherical shape, allowing the notches to match with the nozzle.

3. The cleaning device according to claim 1, wherein each of the fixing parts has a plate structure inclining relatively to the base seat.

4. The cleaning device according to claim 1, wherein the separating plate and each of the fixing parts cooperatively form a fixing groove, one of the two second fixing plates is fixed in the fixing groove.

5. The cleaning device according to claim 1, wherein a rear end of the first fixing plate defines two symmetrical broken corners, a position of the fixing part facing the broken corners defines a fastener for fixing the second fixing plate.

6. The cleaning device according to claim 5, wherein an end opposite to the rear end of the first fixing plate is fixed on the fixing part.

7. The cleaning device according to claim 1, wherein the two fixing parts are symmetrically set, and the rear ends of the scrape components each define two bevels which cooperatively form the notch.

8. A cleaning device for a nozzle, comprising:

a base seat; and a plurality of scrape components, the scrape components being defined on the base seat and arranged in a straight line;

wherein, a rear end of each of the scrape components defines two bevels, one end of one bevel is connected with one end of the other bevel, the other ends of the two bevels incline along directions away from each other respectively the two bevels cooperatively form a notch, when the nozzle is scraped, the nozzle passes through the notches of all the scrape components in sequence, and the bevels rub the nozzle;

wherein, the base seat comprises:

a base; and two fixing parts spaced from each other, wherein each of the fixing parts defines a receiving groove extending from an end of the fixing part away from the base towards the base, each of receiving grooves receives one scrape component;

wherein, the base seat further comprises:

two first fixing plates and two second fixing plates, two opposite sides of each of the fixing parts are fixed with a first fixing plate and a second fixing plate, the first fixing plate and the second fixing plate are parallel to the fixing part respectively, and the rear end of the scrape component with the notch is exposed from the first fixing plate, the second fixing plate, and the fixing part along a direction away from the base;

wherein, the base seat is further defined with a separating plate, the separating plate is located between the second fixing plates of the two fixing parts.

9. The cleaning device according to claim 8, wherein each of the fixing parts has a plate structure inclining relatively to the base seat.

10. The cleaning device according to claim 8, wherein the separating plate and each of the fixing parts cooperatively form a fixing groove, one of the two second fixing plates is fixed in the fixing groove.

11. The cleaning device according to claim 8, wherein a rear end of the first fixing plate defines two symmetrical broken corners, a position of the fixing part facing the broken corners defines a fastener for fixing the second fixing plate.

12. The cleaning device according to claim 11, wherein an end opposite to the rear end of the first fixing plate is fixed on the fixing part.

13. The cleaning device according to claim 12, wherein the end opposite to the rear end of the first fixing plate is fixed on the fixing part through a fastener.

14. The cleaning device according to claim 8, wherein the two fixing parts are symmetrically set.

* * * * *